US009884747B2

(12) United States Patent
Lee

(10) Patent No.: US 9,884,747 B2
(45) Date of Patent: Feb. 6, 2018

(54) SAFETY DEVICE FOR PREVENTING HAND FROM BEING JAMMED IN ELEVATOR DOOR

(71) Applicant: Ho Yeon Lee, Seoul (KR)

(72) Inventor: Ho Yeon Lee, Seoul (KR)

( * ) Notice: Subject to any disclaimer, the term of this patent is extended or adjusted under 35 U.S.C. 154(b) by 366 days.

(21) Appl. No.: 14/763,515

(22) PCT Filed: Feb. 14, 2014

(86) PCT No.: PCT/KR2014/001203

§ 371 (c)(1),
(2) Date: Jul. 26, 2015

(87) PCT Pub. No.: WO2014/148740

PCT Pub. Date: Sep. 25, 2014

(65) Prior Publication Data

US 2016/0016758 A1 Jan. 21, 2016

(30) Foreign Application Priority Data

Mar. 22, 2013 (KR) ..... 10-2013-0030977

(51) Int. Cl.
*B66B 13/14* (2006.01)
*B66B 13/26* (2006.01)

(52) U.S. Cl.
CPC ..... *B66B 13/26* (2013.01)

(58) Field of Classification Search
CPC ..... B66B 13/26
USPC ..... 187/247, 313, 316, 317, 391, 392, 393, 187/396; 318/280–286, 466; 49/26, 28; 160/7, 181, 201; 340/545.3, 545.4, 545.6, 340/545.9, 555, 561, 562; 324/658, 677
See application file for complete search history.

(56) References Cited

U.S. PATENT DOCUMENTS 3,370,677 A * 2/1968 Federmann ..... B66B 13/26 187/317
4,029,176 A * 6/1977 Mills ..... B66B 13/26 187/317
4,410,843 A * 10/1983 Sauer ..... B60J 1/17 219/203
4,452,009 A * 6/1984 Baumeler ..... B66B 13/26 187/317

(Continued)

FOREIGN PATENT DOCUMENTS

JP 2009-084788 4/2009
JP 2009-096584 5/2009

(Continued)

OTHER PUBLICATIONS

International Search Report dated May 20, 2014 From the Korean Intellectual Property Office Re. Application No. PCT/KR2014/001203 and Its Translation Into English.

*Primary Examiner* — Anthony Salata

(57) ABSTRACT

The present invention provides a safety device for preventing a hand from being jammed in an elevator door including a conductive member attached to the surface of the door and the door frame whereby if the conductive member is contacted by the hand, it senses the current of the human body so as to control the elevator door, preventing the hand from being jammed in the door, and directly illuminates the surface of the door so as to enable the person to clearly see the hand contacting the door and to be warned.

17 Claims, 8 Drawing Sheets

(56) References Cited

U.S. PATENT DOCUMENTS 4,506,765 A * 3/1985 Payne ..... B66B 13/26 187/317
4,732,238 A * 3/1988 Baumgartner ..... B66B 13/26 187/317
5,162,711 A * 11/1992 Heckler ..... B66B 13/26 187/317
5,621,290 A * 4/1997 Heller ..... B60J 10/00 307/10.1
5,821,478 A * 10/1998 Schroder-Brumloop ..... B66B 13/143 187/316
6,271,512 B1 * 8/2001 Lewis ..... G01V 8/20 250/214 R
6,304,178 B1 * 10/2001 Hayashida ..... G01V 8/10 340/545.1
6,377,009 B1 * 4/2002 Philipp ..... E05F 15/46 318/266
6,525,659 B2 * 2/2003 Jaffe ..... F25D 23/021 340/545.6
6,631,788 B2 * 10/2003 Shikai ..... B66B 13/26 187/316
6,724,324 B1 * 4/2004 Lambert ..... H03K 17/955 324/663
7,044,271 B2 * 5/2006 De Coi ..... B66B 13/26 187/316
7,093,692 B2 * 8/2006 Koura ..... B66B 13/146 187/316
7,575,101 B2 * 8/2009 Copsey ..... B66B 13/143 187/316
9,052,536 B2 * 6/2015 Artwohl ..... A47F 3/0434
9,234,979 B2 * 1/2016 Bolbocianu ..... G01V 3/02
9,751,727 B1 * 9/2017 Novak ..... B66B 13/26
2011/0295469 A1 * 12/2011 Rafii ..... E05F 15/43 701/49

FOREIGN PATENT DOCUMENTS

KR 10-2011-0006443 1/2011
KR 10-1238068 2/2013
WO WO 2014/148740 9/2014

* cited by examiner

SAFETY DEVICE FOR PREVENTING HAND FROM BEING JAMMED IN ELEVATOR DOOR

RELATED APPLICATIONS

This application is a National Phase of PCT Patent Application No. PCT/KR2014/001203 having International filing date of Feb. 14, 2014, which claims the benefit of priority of Korean Patent Application No. 10-2013-0030977 filed on Mar. 22, 2013. The contents of the above applications are all incorporated by reference as if fully set forth herein in their entirety.

TECHNICAL FIELD

The present invention relates to a safety device for preventing a hand from being jammed in an elevator door, and more particularly, to a device for preventing a hand from being jammed in an elevator door that displays visual information on the surfaces of an elevator door and a door frame so as to visually alert the passenger to the possibility that the passenger's hand will be jammed while controlling the opening or closing of an entrance door or a car door so as not to damage the passenger's hand even though the passenger's hand is jammed between the door and the door frame during the opening of the entrance door or the car door of the elevator.

BACKGROUND ART

In general, an elevator includes an elevator car that moves a passenger while accommodating the passenger and moving up and down along an elevator shaft which is vertically formed in a building, a winding machine and a motor that generates a predetermined power, and control means for moving the elevator car to the corresponding floor by controlling the motor and the winding machine in response to a button operation of the passenger.

A car door that is selectively opened or closed is provided at the elevator car provided in the elevator, and an entrance door that allows the passenger to step on or off at the corresponding floor by being opened or closed in cooperation with the car door is provided at an entrance of each floor of the building.

In this case, a gap exists between an entrance frame and an entrance door so as to allow the entrance door to be smoothly opened or closed. When the passenger waits at the entrance in order to step on the elevator while the passenger puts their hand around this gap, if the passenger does not recognize that the entrance door is opened, and the passenger does not hand off from the entrance door, there is a problem that the passenger' hand is jammed in the gap between the entrance door and the entrance frame and the hand is damaged. Particularly, since a child doesn't pay enough attention, there is a concern about a negligent accident that the child's hand is jammed between the entrance frame and the entrance door and the hand is damaged.

In order to solve such problems, Korean Utility Model Publication No. 20-2010-0010939 is suggested. This technology relates to a device for preventing a hand from being jammed in an elevator, and relates to a device for preventing the passenger's hand or a foreign substance from being jammed in the elevator door having a configuration in which a car door and an entrance door are provided in a fixation section including an upper frame, a left frame and a right frame. In this device, a pair of upper-frame left sensors and a pair of upper-frame right sensors which are object reflection sensors that vertically emit detection light toward the lower side are respectively provided on inner wall surfaces at both ends of the upper frame corresponding to outer surfaces of the entrance door and the car door. A pair of upper-frame central sensors which is object reflection sensors that vertically emit detection light toward the lower side is provided on a central inner wall surface of the upper frame corresponding to the outer surfaces of the entrance door and the car door. In such a configuration, when the elevator door is opened or closed, it is possible to prevent the passenger's hand or various foreign substances from being jammed.

However, since the Utility Model Publication detects the hand or foreign substance by detecting the detection light, even when a box or a bag that does not influence on the opening or closing of the door approaches the door, the device arbitrarily controls the opening or closing of the door by detecting the box or bag. For this reason, the door is forcibly opened or closed often in certain situations, the passenger feels uncomfortable. Since it is necessary to provide a plurality of sensors at the upper frame, there is a problem that the structure thereof is complicated.

Meanwhile, in order to solve the problems of the Utility Model Publication, Japanese Patent Publication No. 2009-515798 is suggested. This technology relates to a door assembly, and a sensor formed using an electrical conductive film is provided on the surface or edge surface of a door panel or a return panel, and a sensor having the same structure is provided at a door frame member.

Accordingly, when the hand touches the surface or edge surface of the door panel or return panel and the current of the human body is detected, the opening or closing of the door panel or return panel is forcibly controlled, and it is possible to prevent the hand from being damaged by being jammed between the elevator door and the frame. However, in the Utility Model Publication, when the human body is simply detected, it is possible to merely prevent the hand from being damaged by opening or closing the door. However, since a direct warning or visual information such as an emergency state is not presented on the door, when the lighting fixture of the elevator is turned off due to blackout, there is a problem that the passenger cannot recognize their position and is embarrassed.

Meanwhile, in a typical elevator, in order to prevent the passenger from leaning against the door and to prevent an overload, a notice sticker on which "Do Not Touch" or "Do Not Lean on. Beware of Falling" is printed should be forcibly attached to a height of 170 to 180 cm from a lower end of the entrance door and the car door under "Elevator Safety Act." However, since the manufactured notice sticker needs to be attached to the car door and the entrance doors of all floors, high cost is required to attach many notice stickers. High cost, a lot of labor and a lot of time are required for maintenance due to the loss and damage of the attached notice stickers, and an external appearance of the elevator is degraded.

In order to solve the problems of the safety device for preventing a hand from being jammed in a door of the related art, the present applicant has suggested Korean Patent Registration No. 10-1238068. This technology relates to a safety device for preventing a hand from being jammed in an elevator door. This safety device includes a door conductive waveguide sheet that is provided on a surface of an elevator door, which is positioned between a car frame and an entrance frame that are respectively provided at an elevator car and an entrance and is opened or closed by the driving of a door driving motor controlled by control means, and that detects a current of a human body, and the control means for determining whether or not a micro-current of the human body when the current is detected through the door conductive waveguide sheet, and a first LED that is provided on one side of a rim of the door conductive waveguide sheet, is turned on by the control of the control means, and irradiate the door conductive waveguide sheet with light. In such a configuration, when the hand touches the corners of the frame of the entrance or the elevator door and the current of the human body is detected, it is possible to prevent the hand from being jammed between the elevator door and the frame by forcibly controlling the elevator door, and it is possible to give a visual warning to the passenger by irradiating the conductive waveguide sheet with the light.

In Korean Patent Registration No. 10-1238068 of the present applicant, the conductive waveguide sheet is provided on the surface of the door, and the light is applied to the surface of the door. However, in the elevator, the width of the door is generally wide so as to allow the passenger to pass with no interference, and thus, the light of the LED provided on one side of the side surface of the door does not sufficiently reach up to the opposite side. For this reason, since a small amount of light is applied to the surface of the door, illuminance is low, and thus, there is a problem that visibility is low.

SUMMARY OF THE INVENTION

In order to solve the above problems, an object of the present invention is to provide a safety device for preventing a hand from being jammed in an elevator door capable of preventing a hand of a passenger who uses an elevator from being jammed between a door and a door frame by being turn on at the rear of the conductive member attached to the surfaces of the door and the door frame to detect a human body and directly irradiating a conductive member with light to increase visibility.

Technical Solution

In order to achieve the above object, the present invention provides a safety device for preventing a hand from being jammed in an elevator door.

The safety device includes a door LED board that is provided on a surface of an elevator door opened or closed by the driving of a door driving motor, which is positioned between a car frame and an entrance frame provided at an elevator car and an elevator entrance and is controlled by control means, and that is provided on a surface of a door LED board configured such that a plurality of door LEDs which is turned on or off by the control means is provided on a surface of a door printed circuit board (PCB), and a door conductive member that is provided on a surface of the door LED board so as to turn on the door LEDs by the control means when a current of a human body is detected, and that is made of a transparent or translucent material.

In this case, the door conductive member may be an electrical conductivity sheet that is attached to surfaces of the car door and the entrance door, and may be obtained by mixing plastic resin with electrical conductive material powder at a predetermined percentage by weight, and the door printed circuit board (PCB) may be a flexible printed circuit board.

The door conductive member may be a conductive plastic panel obtained by mixing plastic resin with electrical conductive material powder at a predetermined percentage by weight and performing injection molding on the mixed resultant so as to form a LED accommodation groove in which the door LEDs are settled The door conductive member may be obtained by forming a conductive layer on a surface of a non-conductive plastic panel manufactured by performing injection molding on a plastic resin so as to form a LED accommodation groove in which the door LEDs are settled.

The door conductive member may be made of a metallic electrical conductive material, may be provided with light transmission holes punched in a surface thereof, and may allow light to transmit when the door LEDs of the door LED board are turned on.

The safety device may further include a frame LED board that is configured such that a plurality of frame LEDs is provided a frame printed circuit board (PCB) on surfaces of corners of the car frame and the entrance frame, and a frame conductive member that is provided on a surface of the frame LED board to detect the current of the human body.

The frame conductive member may be a conductive plastic panel obtained by mixing plastic resin with electrical conductive material powder and performing injection molding on the mixed resultant so as to form a LED accommodation groove in which the frame LEDs are settled.

The frame conductive member may be obtained by forming a conductive layer on a surface of a non-conductive plastic panel through injection molding so as to form a LED accommodation groove in which the frame LEDs are settled.

The frame LED board and the frame conductive member are integrally fixed within a cover, a fastening hole may be formed in the cover, and the frame LED board and the frame conductive member may be integrally fixed to the surfaces of corners of the car frame and the entrance frame by using a screw or may be integrally fixed to the surfaces thereof by using an adhesive or an adhesion tape.

Settlement grooves may be formed in the door, the car frame and entrance frame, and a set of the frame LED board and the frame conductive member, and a set of the door LED board and the door conductive member may be respectively provided in the settlement grooves so as to be buried.

The door conductive member may be made of a metallic electrical conductive material, may be provided with a light transmission hole in a surface thereof, and a light diffusion layer made of a silicon or rubber material to which a light diffusing material is added may be provided between the door conductive member and the door LED board. The frame conductive member may be provided with a light transmission hole, and a light diffusion layer made of a silicon material to which a light diffusing material is added may be provided between the frame conductive member and the frame LED board.

The door conductive member may be provided with a LED settlement hole in which the door LEDs are settled, and the frame conductive member may be provided with a LED settlement hole in which the frame LEDs are settled.

The safety device may further include a non-conductive member that is provided with a LED settlement hole in which the door LEDs are settled between the door conductive member and the door LED board, and may further include a non-conductive member that is provided with a LED settlement hole in which the frame LEDs are settled between the frame conductive member and the frame LED board.

Effect of the Invention

According to the present invention, when the conductive members are attached to the surfaces of the elevator door and the door frame and the current of the human body is detected due to the touch of the hand, it is possible to prevent the hand from being damaged by being jammed between the elevator door and the frame by forcibly controlling the elevator door. Further, since illuminance is increased by directly irradiating the surface of the door with light and the fact that the passenger's hand touches the surface of the door is visually displayed with vividness, it is possible to more surely alert the passenger to the possibility of the hand jamming.

DESCRIPTION OF SPECIFIC EMBODIMENTS OF THE INVENTION

Figure 1:
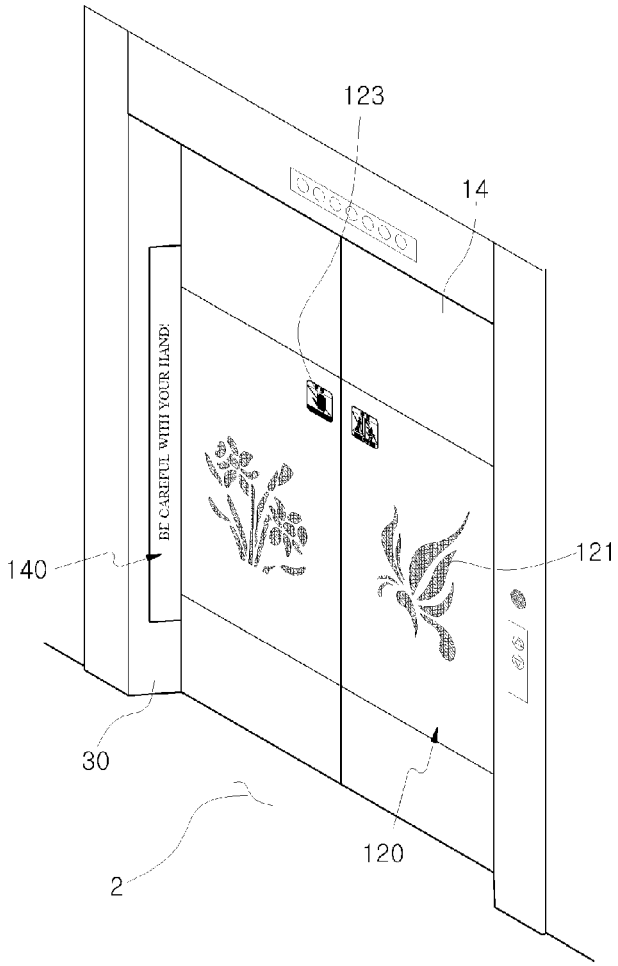
FIG. 1 is a perspective view of an entrance for describing a safety device for preventing a hand from being jammed in an elevator door according to the present invention.
Figure 2:
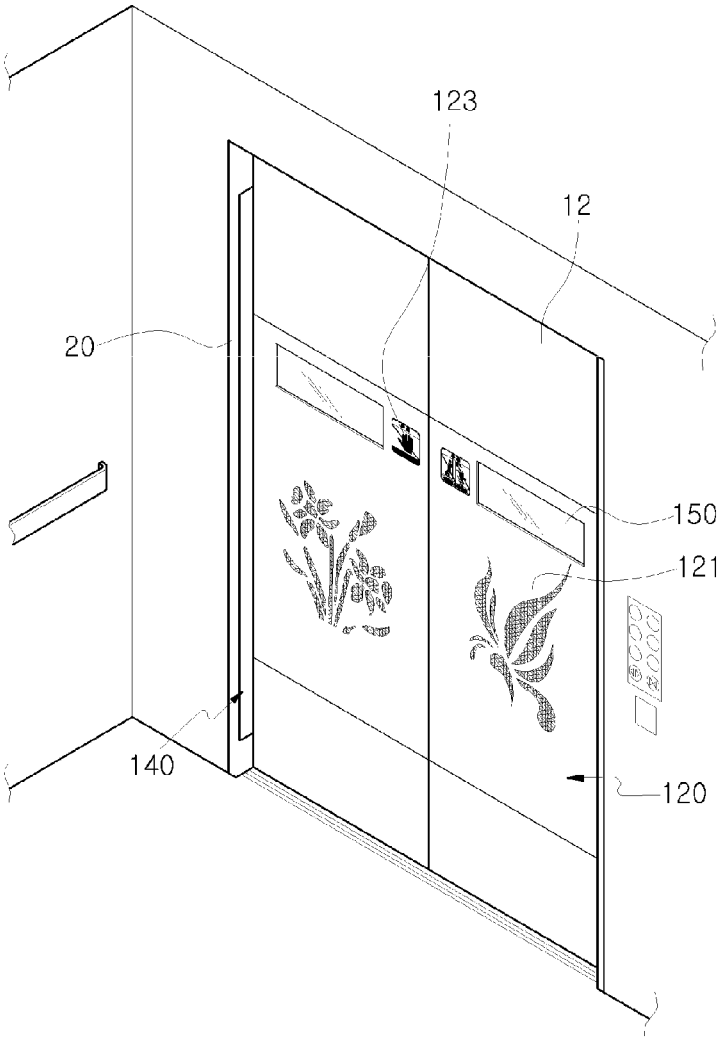
FIG. 2 is an internal perspective view of an elevator car for describing the safety device for preventing a hand from being jammed in an elevator door according to the present invention.
Figure 3:
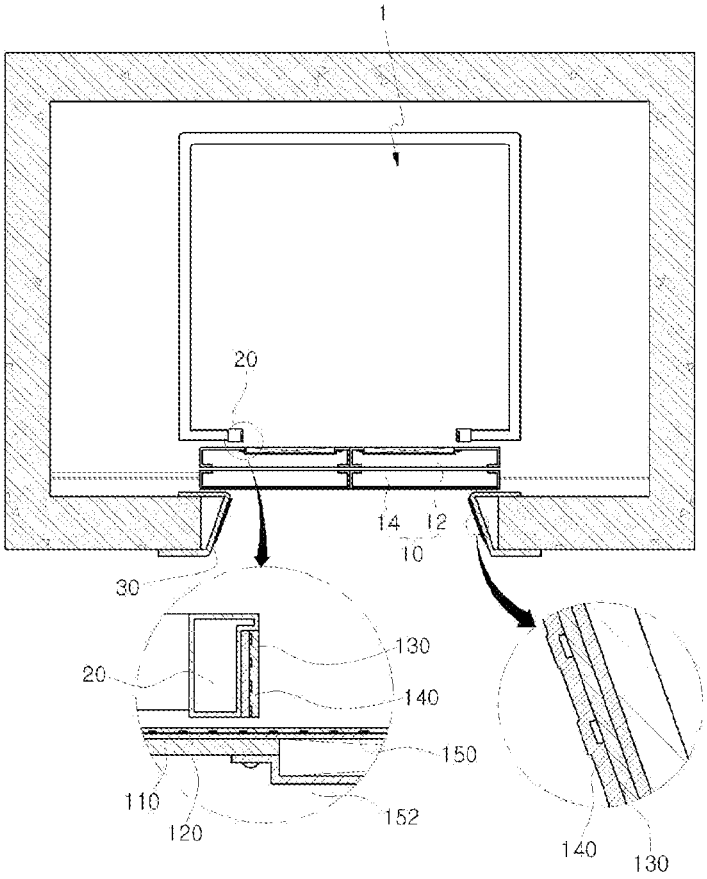
FIG. 3 is a sectional view of an elevator for describing the safety device for preventing a hand from being jammed in an elevator door according to the present invention.
Figure 4:
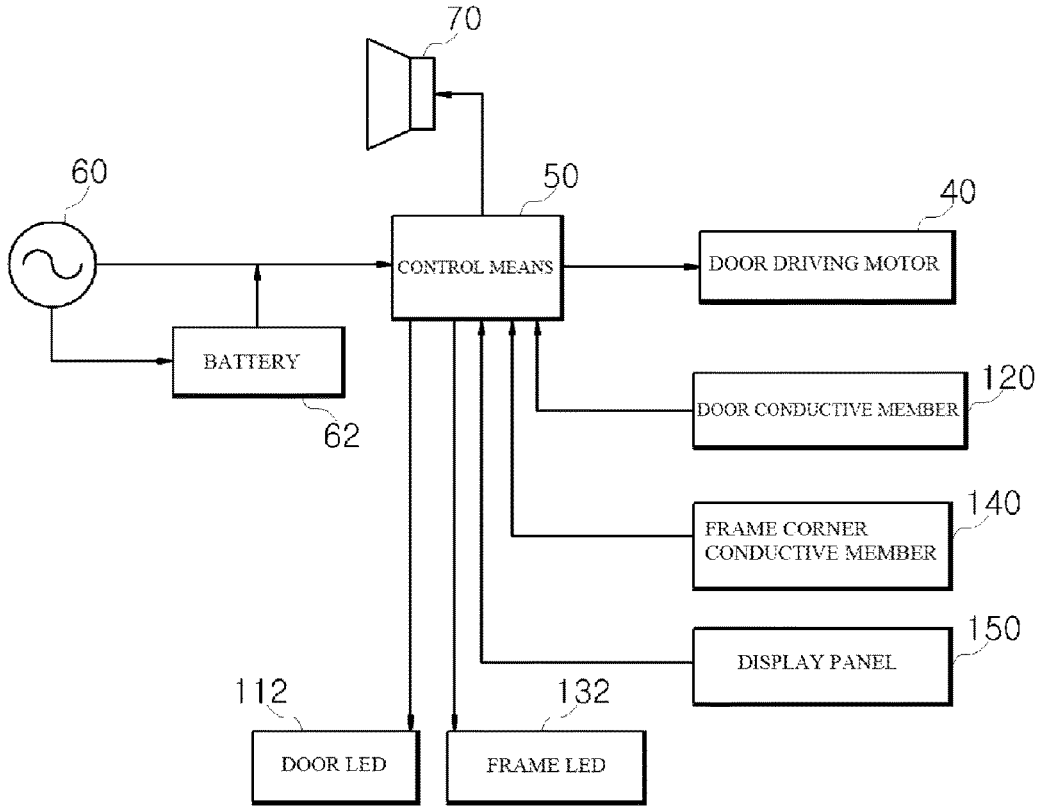
FIG. 4 is a control block diagram for preventing a hand from being jammed in an elevator door according to the present invention.
Figure 5:
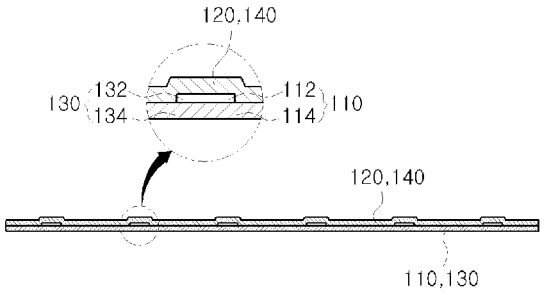
FIG. 5 is a sectional view showing the safety device for preventing a hand from being jammed in an elevator door according to the present invention.

Hereinafter, a safety device for preventing a hand from being jammed in an elevator door according to the present invention will be described in detail with reference to the accompanying drawings.

FIGS. 1, 2, 3, 4 and 5 are diagrams for describing the safety device for preventing a hand from being jammed in an elevator door according to an embodiment of the present invention.

According to the present embodiment, an elevator that allows a passenger to easily move up and down is provided in a building, and an elevator door 10 that allows the passenger to step on or off is provided in an elevator car 1 and the elevator entrance of each floor in the building.

The elevator door 10 includes a car door 12 that is provided in the elevator car 1, and an entrance door 14 that is provided in the entrance of the elevator entrance 2 of each floor so as to be opened or closed in cooperation with the car door 12.

In this case, the car door 12 and the entrance door 14 are respectively positioned between a car frame 20 and an elevator entrance frame 30 which are door frames provided within the elevator entrance 2 and the elevator car 1, and are opened or closed depending on the driving of a door driving motor 40.

Of course, the door driving motor 40 is controlled under the control of control means 50 so as to open or close the doors.

The safety device for preventing a hand from being jammed in an elevator door according to the present invention is provided in such an elevator.

The safety device for preventing a hand from being jammed according to the present invention is provided on the surface of the elevator door 10. The safety device includes a door LED board 110 in which a plurality of door LEDs 112 is provided on the surface of a door printed circuit board (PCB) 114, and a door conductive member 120 that is provided on the surface of the door LED board 110 and detects the current of a human body. In this safety device, when a detection signal is input by detecting the current of the human body through the door conductive member 120, the control means 50 controls the door LEDs 112 to be turned on such that the door conductive member 120 is irradiated with light.

In this case, the door LED board 110 and the door conductive member 120 may be sequentially attached onto the surface of the elevator door 10, or the door LED board 110 and the door conductive member 120 may be attached to the surface of the elevator door 10 while being integrally coupled to each other.

The door LED board 110 is configured such that the plurality of door LEDs 112 is provided on the surface of the door printed circuit board (PCB) 114, and irradiates the door conductive member 120 with light when the door LEDs 112 are turned on. It is preferable that the door printed circuit board 114 is a flexible printed circuit board (FPCB) and is attached to the surface of the door 10 by using an adhesive.

The door conductive member 120 is attached to the surface of the car door 12 and the entrance door 14, is formed using a transparent or translucent film made of a plastic (synthetic resin) material such as PP, PC, PE, PET, PI, PU, ABS, or PVC, and is an electrical conductive sheet obtained by mixing plastic resin with carbon or metallic powder which is an electrical conductive material at a predetermined percentage by weight.

Of course, the door conductive member 120 may be formed by coating the surface of the door LED board 110 with a conductive paint.

Particularly, various designs 121 such as numbers, letters, figures, symbols, and patterns may be formed on the surface of the door conductive member 120. For example, since a warning sticker to be necessarily attached to the door 10 can be replaced with the door conductive member 110, it is possible to prevent degradation in the external appearance of the elevator, and it is possible to provide visual information such as various designs capable of exhibiting an interior effect of the inside of the elevator car to passengers who use the elevator.

Meanwhile, when the door LEDs 112 of the door LED board 110 are turned on, even though a lighting fixture in the elevator car is turned off due to a blackout, the passenger can easily recognize the position of the door 10. In a normal state, the door LEDs 112 are turned on when the human body is detected using commercial power supply 60. In an emergency state where the supply of power is stopped, the door LEDs are turned on by receiving a power of a battery 62 charged by the commercial power supply 60.

In this case, a notice 123 indicating "Do Not Touch" or "Do Not Lean on. Beware of Falling" is printed on the door conductive member 120 in various colors, and is expressed in color similar to an actual notice sticker.

In this case, a current detecting unit (not shown) for detecting whether or not the power is supplied from the commercial power supply 60 is provided. The control means 50 monitors whether or not the power is consecutively supplied from the commercial power supply 60, and controls the door LEDs 112 to be turned on when the supply of the power from the commercial power supply 60 is blocked.

The door conductive member 120 is preferably attached at a height of 50 cm or more from the lower parts of the entrance door 14 and the car door 12 as the elevator door 10.

Meanwhile, a frame LED board 130 in which a plurality of frame LEDs 132 is provided at a frame printed circuit board (PCB) 134, and a frame conductive member 140 that is provided on the surface of the frame LED board 130 to detect the current of the human body are further provided on the surfaces of the corners of the car frame 20 and the entrance frame 30.

In this case, the frame LED board 130 has the same structure as that of the door LED board 110, and the frame conductive member 140 has the same structure as that of the door conductive member 120.

The door LED board 110 and the Door conductive member 120, and the frame LED board 130 and the frame conducive member 140 can be attached to the corners of the frames 20 and 30 or the door 10, and thus, it is possible to conveniently attach the safety device to the existing elevator without newly replacing the elevator with new one.

When the current is detected in the door conductive member 110 and the frame conductive member 130, the control means 50 determines whether or not the detected current is the micro-current of the human body. The control means controls the door driving motor 40, and turns on the door and frame LEDs 112 and 132 so as to allow the passenger who uses the elevator to recognize the visual information. In so doing, light transmits through the surfaces of the door conductive member 110 and the frame conductive member 130, and thus, predetermined visual information is displayed on the door 10, the car frame 20 and the entrance frame 30.

That is, when the current is detected in the door conductive member 110 or the frame conductive member 130 while the door driving motor 40 is driven and the door 10 is opened, the control means 50 stops the driving of the door driving motor 40 for a predetermined period of time (for example, 1 or 2 seconds), and controls the driving of the door driving motor 40 so as to open the elevator door 10. When the current is detected while the elevator door 10 is closed, the control means drives the door driving motor 40 to open the elevator door 10, maintains the opened state for a predetermined period of time (for example, 1 or 2 seconds), and controls the driving of the door driving motor 40 so as to normally close the door again. When the human body is detected, the control means turns on the door and frame LEDs 112 and 132 to give a visual warning to the passenger.

Meanwhile, a display panel 150 such as a LCD is provided on the surface of the elevator door 10 so as to be buried. Particularly, the display panel 150 is provided to display daily living information such as advertisements, promotional videos, news, and weather useful for the passenger who uses the elevator, and is provided at the car door 12. The display panel 150 is provided such that a fixation groove 11 is formed in the surface of the elevator door 10, the display panel 150 is buried in the groove, and the display panel is integrally fixed using a fixation bracket 152.

A speaker 70 is provided on one side of the car frame 20 and the entrance frame 30, and when the current is detected in the door conductive member 110 and the frame conductive member 130, the control means 50 preferably controls the speaker 70 to output warning sound. In this case, the control means 50 may further include a memory unit (not shown) that stores a warning guide comment, and the warming guide comment, for example, "Do Not Touch Door" may output as voice.

Figure 6:
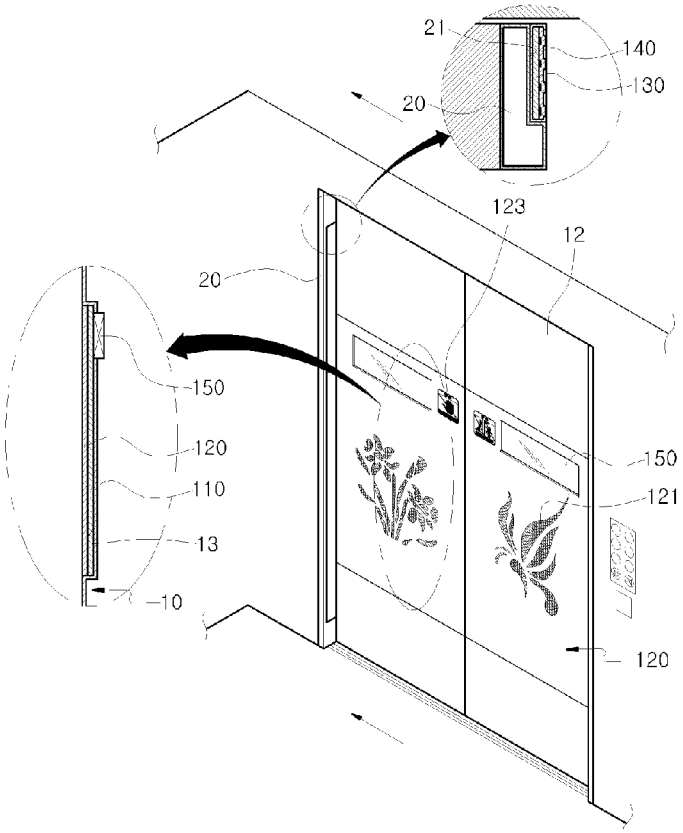
FIG. 6 is a diagram showing a safety device for preventing a hand from being jammed in an elevator door according to another embodiment of the present invention.

FIG. 6 is a diagram showing another embodiment of the present invention. A settlement groove 13 is formed in the surface of the door 10, and the door LED board 110 and the door conductive member 120 are settled in the settlement groove. The surface of the door conductive member 120 and the surface of the door 10 have the same height, and thus, when the door 10 is opened or closed, it is possible to prevent the interference between the car frame 20 and the entrance frame 30.

A settlement groove 21 is formed in the car frame 20, and the frame LED board 130 and the frame conductive member 140 are provided in the settlement groove so as to be buried. Of course, a settlement groove (not shown) is formed in the entrance frame 30, and the frame LED board 130 and the frame conductive member 140 are provided in the settlement groove so as to be buried.

Figure 7:
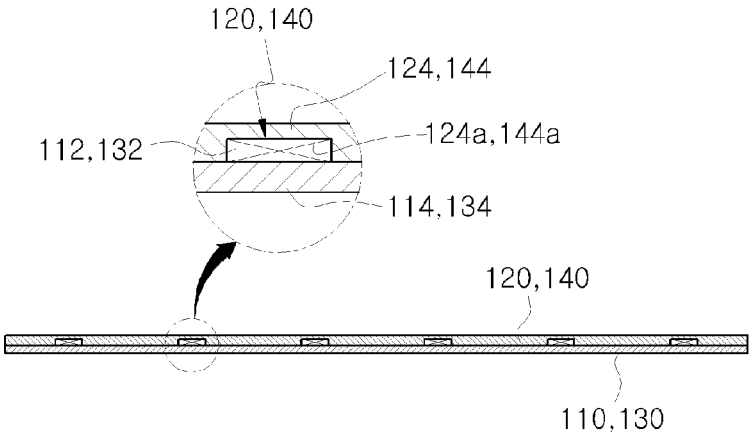
FIG. 7 is a sectional view showing a safety device for preventing a hand from being jammed in an elevator door according to still another embodiment of the present invention.

Meanwhile, FIG. 7 is a diagram showing still another embodiment of the present invention. The door conductive member 120, which is provided on the surface of the door LED board 110 in which the plurality of door LEDs 112 is provided in the door printed circuit board (PCB) 114 and detects the current of the human body, is a conductive plastic panel 124 obtained by mixing a plastic (synthetic resin) material with carbon or metallic powder which is an electrical conductive material at a predetermined percentage by weight and performing injection molding on the resultant so as to form a LED accommodation groove 124*a* in which the door LEDs 112 are settled. In this case, the conductive plastic panel 124 is manufactured by mixing a transparent or translucent acrylic resin with carbon or metallic powder which is an electrical conductive material.

The conductive plastic panel 124 is integrally coupled to the door printed circuit board 110 by using an adhesive. In this case, as the door printed circuit board (PCB) 114, a typical PCB is preferably used without using a flexible printed circuit board.

Of course, the frame conductive member 140, which is provided on the surface of the frame LED board 130 in which the plurality of frame LEDs 132 is provided at the frame printed circuit board (PCB) 134 and detects the current of the human body, is also a conductive plastic panel 144 obtained by mixing a plastic (synthetic resin) material with carbon or metallic powder which is an electrical conductive material at a predetermined percentage by weight and performing injection molding on the resultant so as to form a LED accommodation groove 144*a* in which the frame LEDs 132 are settled.

Figure 8:
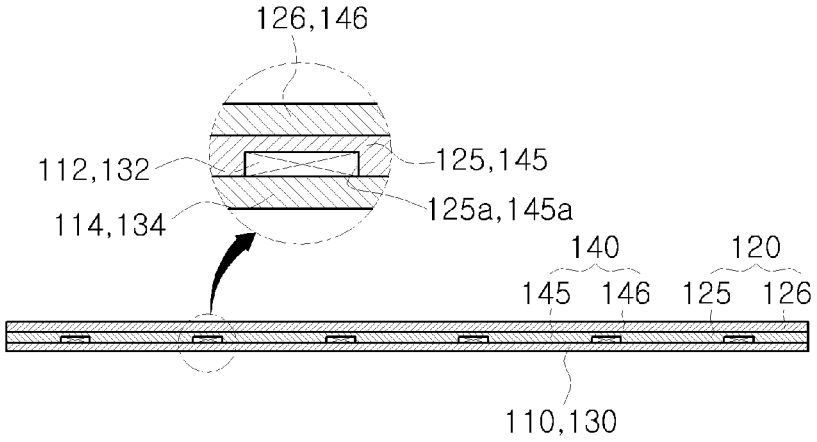
FIG. 8 is a sectional view showing a safety device for preventing a hand from being jammed in an elevator door according to still another embodiment of the present invention.

FIG. 8 is a diagram showing still another embodiment of the present invention. The door conductive member 120 is provided by forming a conductive layer 126 on the surface of a non-conductive plastic panel 125 manufactured by performing injection molding on plastic resin such that a LED accommodation groove 125*a* in which the door LEDs 122 are settled is formed.

In this case, the conductive layer 126 is formed using a transparent or translucent film made of a plastic (synthetic resin) material such as PP, PC, PE, PET, PI, PU, ABS, or PVC, is an electrical conductive film obtained by mixing plastic resin with carbon or metallic powder which is an electrical conductive material at a predetermined percentage by weight, and is integrally attached to the surface of the non-conductive plastic panel 125.

The frame conductive member 140 that is provided on the surface of the frame LED board 130 to detect the current of the human body is also provided by forming a conductive layer 146 on the surface of a non-conductive plastic panel 145 manufactured through injection molding such that a LED accommodation groove 145*a* in which the frame LED 132 is settled is formed.

Of course, the conductive layers 126 and 146 are preferably formed on the surfaces of the non-conductive plastic panels 125 and 145 through electroplating, chemical plating, or coating or depositing of conductive ink.

Figure 9:
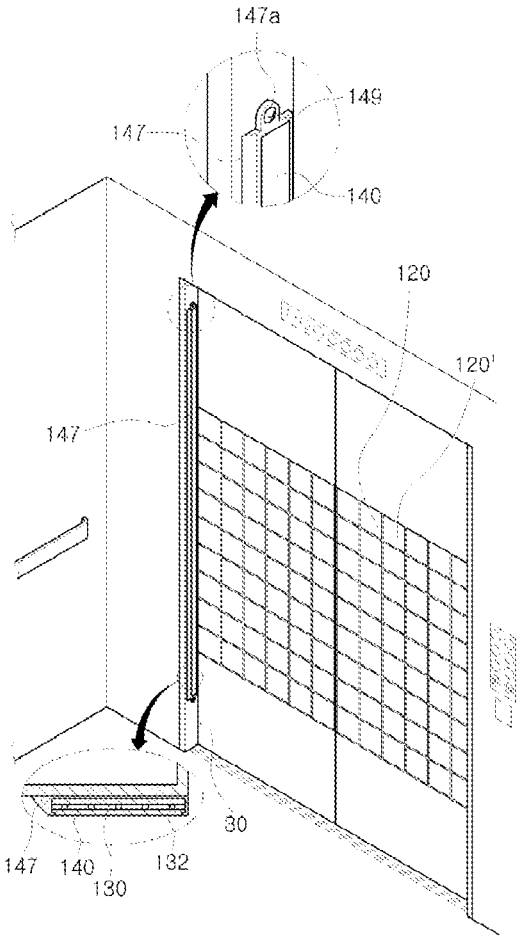
FIG. 9 is a diagram for describing a safety device for preventing a hand from being jammed in an elevator door according to still another embodiment of the present invention.

FIG. 9 is a diagram showing still another embodiment of the present invention. The door conductive member 120 may be manufactured in a rectangle shape, and may be arranged in a check pattern. In this case, a wire is preferably formed between the neighboring door conductive members 120 and 120' so as to allow current to flow therebetween.

Of course, although not shown, the door conductive member 120 may be manufactured in various shapes such as a circle, a triangle, a diamond, and a hexagon in addition to the rectangle, and may be attached to the door or the frame. As stated above, it is possible to expect a design effect of the safety device by forming the shape of the door conductive member 120 in various shapes.

The frame LED board 130 and the frame conductive member 140 are integrally fixed within a cover 147 made of a metallic or plastic material, and a fastening hole 147*a* is formed in the cover 147. The frame LED board and the frame conductive member are integrally fixed to the corner surfaces in positions of the car frame 20 and the entrance frame 30 adjacent to the door by using a screw 149. In this case, the cover 147 is fixed using the screw 149 while coming in close contact with the surfaces of the car frame 20 and the entrance frame 30. Of course, the cover 147 may be fixed through an adhesive or an adhesion tape.

Figure 10:
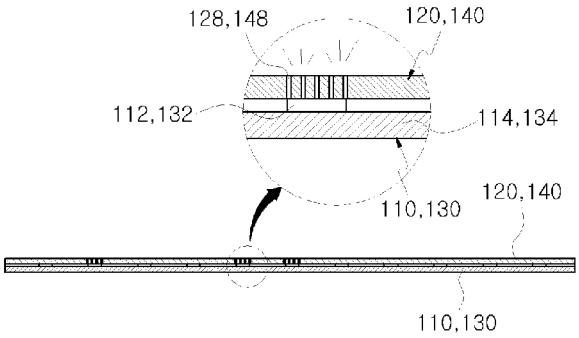
FIG. 10 is a sectional view showing a safety device for preventing a hand from being jammed in an elevator door according to still another embodiment of the present invention.

FIG. 10 is a diagram showing still another embodiment of the present invention. The door conductive member 120 and the frame conductive member 140 are made of an electrical conductive material such as a nonferrous metallic material or a metallic material such as copper, aluminum or carbon which has excellent electrical conductivity. Light transmission holes 128 and 148 having various shapes and sizes are formed in the surfaces thereof through punching. When the door LEDs 112 and the frame LEDs 132 of the door LED board 110 and the frame LED board 130 are turned on, light transmits through the transmission holes 128 and 148. In this case, the light transmission holes 128 and 148 may be punched in various shapes and sizes such as numbers, letters, figures, symbols, and patterns.

Figure 11:
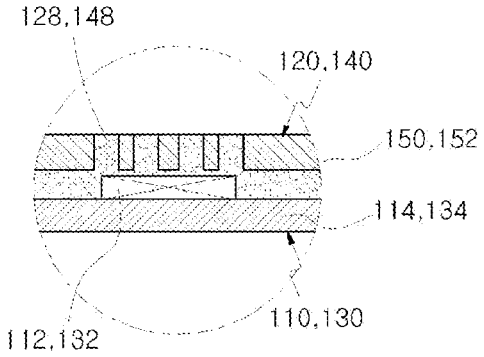
FIGS. 11(*a*), 11(*b*) and 11(*c*) are sectional views showing a safety device for preventing a hand from being jammed in an elevator door according to still another embodiment of the present invention.
Figure 11:
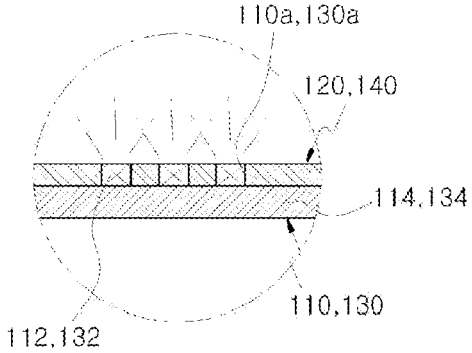
Figure 11:
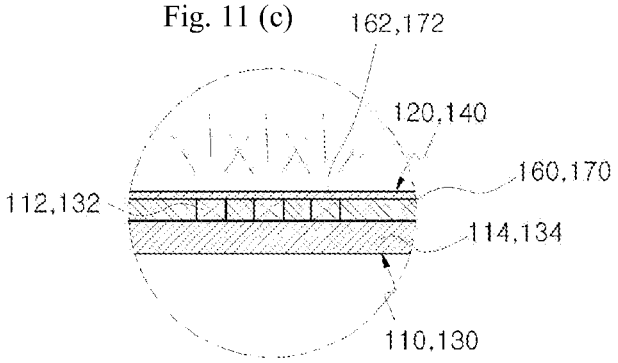

Meanwhile, FIGS. 11A to 11C are diagrams showing still another embodiment of the present invention. Referring to FIG. 11A, a light diffusion layer 150 made of a silicon or rubber material to which a light diffusing material is added is provided between the door LED board 110 and the door conductive member 120 in which the light transmission hole 128 is formed, and a light diffusion layer 152 mad of a silicon or rubber material to which a light diffusing material is added is provided between the frame LED board 130 and the frame conductive member 140 in which the light transmission hole 148 is formed.

By the use of the light transmission layers 150 and 152, when the door LEDs 112 and the frame LEDs 132 are turned on, the light diffuses while passing through the light diffusion layers 150 and 152, and transmits through the light transmission holes 128 and 148. As a result, it is possible to create a luxurious atmosphere.

Referring to FIG. 11B, the door conductive member 120 and the frame conductive member 140 that are provided with the LED settlement holes 110*a* and 130*a* in which the door LEDs 112 and the frame LEDs 132 are settled come in close contact with the surfaces of the door LED board 110 and the frame LED board 130. Referring to FIG. 11C, non-conductive members 160 and 170 that are provided with the LED settlement holes 162 and 172 in which the door LEDs 112 and the frame LEDs 132 are settled come in close contact with the surfaces of the door LED board 110 and the frame LED board 130. That is, the non-conductive member 160 is further provided between the door conductive member 120 and the door LED board 110, and the non-conductive member 170 is further provided between the frame conductive member 140 and the frame LED board 130.

In this case, the non-conductive members 160 and 170 may be made of various materials such as a wood material, a glass material, and a marble material, and thus, it is possible to create various atmospheres.

Although the embodiments of the present invention have been described in detail, the scope of the present invention is not limited thereto. Equivalents to the embodiments of the present invention would fall within the scope of the present invention.

INDUSTRIAL APPLICABILITY

The present invention provides a device for preventing a hand from being jammed in an elevator door that displays visual information on the surfaces of an elevator door and a door frame so as to visually alert the passenger to the possibility that the passenger's hand will be jammed while controlling the opening or closing of an entrance door or a car door so as not to damage the passenger's hand even though the passenger's hand is jammed between the door and the door frame during the opening of the entrance door or the car door of the elevator.

What is claimed is:

1. A safety device for preventing a hand from being jammed in an elevator door, the safety device comprising:

a door LED board (110) that is provided on a surface of an elevator door (10) opened or closed by the driving of a door driving motor (40), which is positioned between a car frame (20) and an entrance frame (30) provided at an elevator car (1) and an elevator entrance (2) and is controlled by control means (50), and that is provided on a surface of a door LED board (110) configured such that a plurality of door LEDs (112)

which is turned on or off by the control means (50) is provided on a surface of a door printed circuit board (PCB) (114);

a door conductive member (120) that is provided on a surface of the door LED board (110) so as to turn on the door LEDs (112) by the control means (50) when a current of a human body is detected, and that is made of a transparent or translucent material;

a frame LED board (130) that is configured such that a plurality of frame LEDs (132) is provided a frame printed circuit board (PCB) (134) on surfaces of corners of the car frame (20) and the entrance frame (30); and a frame conductive member (140) that is provided on a surface of the frame LED board (130) to detect the current of the human body.

2. The safety device of claim 1, wherein the door conductive member (120) is an electrical conductivity sheet that is attached to surfaces of the car door (12) and the entrance door (14), and is obtained by mixing plastic resin with electrical conductive material powder at a predetermined percentage by weight, and the door printed circuit board (PCB) (114) is a flexible printed circuit board.

3. The safety device of claim 1, wherein the door conductive member (120) is a conductive plastic panel (124) obtained by mixing plastic resin with electrical conductive material powder at a predetermined percentage by weight and performing injection molding on the mixed resultant so as to form a LED accommodation groove (124*a*) in which the door LEDs (112) are settled.

4. The safety device of claim 1, wherein the door conductive member (120) is obtained by forming a conductive layer (126) on a surface of a non-conductive plastic panel (125) manufactured by performing injection molding on a plastic resin so as to form a LED accommodation groove (125*a*) in which the door LEDs (122) are settled.

5. The safety device of claim 1, wherein the door conductive member (120) is made of a metallic electrical conductive material, is provided with light transmission holes (128, 148) punched in a surface thereof, and allows light to transmit when the door LEDs (112) of the door LED board (110) are turned on.

6. The safety device of claim 1, wherein the frame conductive member (140) is a conductive plastic panel (144) obtained by mixing plastic resin with electrical conductive material powder and performing injection molding on the mixed resultant so as to form a LED accommodation groove (144*a*) in which the frame LEDs (132) are settled.

7. The safety device of claim 1, wherein the frame conductive member (140) is obtained by forming a conductive layer (146) on a surface of a non-conductive plastic panel (145) through injection molding so as to form a LED accommodation groove (145*a*) in which the frame LEDs (132) are settled.

8. The safety device of claim 1, wherein the frame LED board (130) and the frame conductive member (140) are integrally fixed within a cover (147), a fastening hole (147*a*) is formed in the cover (147), and the frame LED board and the frame conductive member are integrally fixed to the surfaces of corners of the car frame (20) and the entrance frame (30) by using a screw (149).

9. The safety device of claim 1, wherein the frame LED board (130) and the frame conductive member (140) are integrally fixed within a cover (147), and are integrally fixed to the surfaces of corners of the car frame (20) and the entrance frame (30) through an adhesive or an adhesion tape.

10. The safety device of claim 1, wherein a settlement groove (21) is formed in the car frame (20), and the frame LED board (130) and the frame conductive member (140) are provided in the settlement groove so as to be buried.

11. The safety device of claim 1, wherein the settlement groove (13) is formed in a surface of the door (10), and the door LED board (110) and the door conductive member (120) are provided in the settlement groove so as to be buried.

12. The safety device of claim 1, wherein the door conductive member (120) is made of a metallic electrical conductive material, is provided with a light transmission hole (128) in a surface thereof, and a light diffusion layer (150) made of a silicon or rubber material to which a light diffusing material is added is provided between the door conductive member (120) and the door LED board (110).

13. The safety device of claim 1, wherein the frame conductive member (140) is provided with a light transmission hole (148), and a light diffusion layer (152) made of a silicon material to which a light diffusing material is added is provided between the frame conductive member (120) and the frame LED board (110).

14. The safety device of claim 1, wherein the door conductive member 120 is provided with a LED settlement hole (110*a*) in which the door LEDs (112) are settled.

15. The safety device of claim 1, wherein the frame conductive member (140) is provided with a LED settlement hole (130*a*) in which the frame LEDs (132) are settled.

16. The safety device of claim 1, further comprising:

a non-conductive member (160) that is provided with a LED settlement hole (162) in which the door LEDs (112) are settled between the door conductive member (120) and the door LED board (110).

17. The safety device of claim 1, further comprising:

a non-conductive member (170) that is provided with a LED settlement hole (172) in which the frame LEDs (132) are settled between the frame conductive member (140) and the frame LED board (130).

* * * * *